US007074166B2

(12) United States Patent
Weitzman

(10) Patent No.: US 7,074,166 B2
(45) Date of Patent: Jul. 11, 2006

(54) EXERCISE APPARATUS AND METHOD

(76) Inventor: Bernard Weitzman, 685 W. End Ave., #12D, New York, NY (US) 10025

( * ) Notice: Subject to any disclaimer, the term of this patent is extended or adjusted under 35 U.S.C. 154(b) by 156 days.

(21) Appl. No.: 10/298,117

(22) Filed: Nov. 15, 2002

(65) Prior Publication Data

US 2003/0096685 A1 May 22, 2003

Related U.S. Application Data

(60) Provisional application No. 60/335,854, filed on Nov. 16, 2001.

(51) Int. Cl.
*A63B 26/00* (2006.01)

(52) U.S. Cl. ..... 482/142; 482/148; 446/220; 5/665

(58) Field of Classification Search ..... 482/140, 482/142; 5/447, 450, 453, 713, 706, 709
See application file for complete search history.

(56) References Cited

U.S. PATENT DOCUMENTS 4,193,149 A * 3/1980 Welcj ..... 5/447
5,024,011 A * 6/1991 Collins ..... 40/124.01
5,234,726 A * 8/1993 Dahan ..... 428/9
5,634,224 A * 6/1997 Gates ..... 5/709
6,131,219 A * 10/2000 Roberts ..... 5/644
6,711,771 B1 * 3/2004 Cook et al. ..... 5/713

* cited by examiner

*Primary Examiner*—Gregory L. Huson
*Assistant Examiner*—L. Amerson

(57) ABSTRACT

This invention relates to health and fitness, and more particularly to exercise methods and devices. More particularly, the invention is directed to stretching exercises and physical therapy, for example an apparatus and exercises for lower back pain. The exercise apparatus comprises at least three cells abutting each other on a common base or frame. Each cell can be independently inflated and deflated to provide an adjustable support cushion having a range of shapes and firmness. An articulated frame is optionally provided for additional independent movement of the cells. Users lie down on the cushion and produce precise stretches and exercises by controlling the rate and degree of inflation or deflation of each cell or group of cells, and optionally, articulated movement of the frame. Stretching can occur passively, as when the body conforms to the shape of the cushion, or actively by exercising in concert with the conformation of the cushion.

45 Claims, 2 Drawing Sheets

EXERCISE APPARATUS AND METHOD

This application claims priority from Provisional Application No. 60/335,854 filed on Nov. 16, 2001.

FIELD OF THE INVENTION

This invention relates to health and fitness, and more particularly to exercise methods and devices. More particularly, the invention is directed to stretching exercises and physical therapy, for example an apparatus and exercises for lower back pain.

BACKGROUND OF THE INVENTION

Lower back pain is widespread in our civilization. It has been estimated, for example by the US government, that its cost to the economy is second only to upper respiratory infection. Many forms of treatment are employed. These include verbal, psychotherapeutic or educational interventions, massage, exercise, physical therapy, and surgery. The usefulness of all of these approaches is real, but limited. Some people are helped by each of them; many are not.

There is little doubt that stress and anxiety, both of which are invariably accompanied by muscular tension, are key factors. Psychotherapeutic and educational interventions that are helpful in reducing exposure to stress can be effective. Approaches that are helpful in reducing anxiety are also helpful. Muscles that are held in spasm accumulate toxins that progressively aggravate the condition. Massage is helpful in bringing temporary relief from such discomfort. Analysis of the muscle groups at risk can lead to an understanding of what regimen of exercise might strengthen supporting musculature and reduce liability to further injury. For most people suffering from lower back pain, however, physical therapy is necessary. Physical therapy may include strengthening exercises and the use of hot and cold and electrical stimulation to increase blood flow and hasten the healing of injured tissues. At the same time, physical therapy will almost certainly include stretching as a principle therapeutic modality.

It has long been known that a precise stretch of muscle tissue results in a muscle relaxation response. A stretch that attains the appropriate angle and degree tends to achieve the goals of relaxation, stimulation, and physical wellbeing. Many methods of achieving precision stretches have been developed and implemented throughout the world. In North America, such methods have been developed for example by physical therapists, physical trainers and body workers in a variety of traditions.

Although the benefits of precise stretching are clear, it is difficult for individuals to effectively apply and obtain precision stretching techniques in a reliable and reproducible way, and especially in an independent or unassisted physical therapy or exercise program. It has also been difficult for therapists to determine the precise stretches that are helpful, and it has been quite difficult to optimize a stretching program for individual patients. Precision stretching for individuals suffering from acute or chronic lower back pain has been markedly difficult to achieve. Individuals suffering lower back pain are easily frightened by manipulations of the body, or by any verbal suggestion that a particular movement be initiated. The experience of such individuals is that any movement could initiate a spasm of agonizing pain. Further, the precise angle and degree of stretch needed to achieve a meaningful benefit can only be approximated from an observer's standpoint. This is the case because the angle and degree of stretch that is needed brings the relevant muscles into contact with the verge, the edge of the pain. When the contact is precise, the individual is able to feel the holding patterns involved and to gradually release them. The stretch then needs to be increased, again moved to the edge of the pain. Because these angles and degrees of stretch can only be known precisely by the direct experience of the person being treated, it is difficult for a therapist to make precise judgments. Thus, an individual working alone may not initiate an appropriately precise stretch, for example from fear of pain, nor can a therapist make independent judgments about the quality of the stretch. These problems may particularly affect the elderly, very young, or persons suffering from illness or injury.

For all of these reasons, there is a need for improved stretching exercises and devices, and in particular for devices and methods which provide a reliable and reproducible precision stretch.

SUMMARY OF THE INVENTION

The present invention provides an apparatus and methods for exercise and physical therapy, particularly for the back, and for treating back pain. The invention is therapeutically applicable to a wide range of conditions affecting the middle back, upper back, lower back, shoulder, neck, arm pelvis and legs. The invention is suitable for any condition or syndrome that is maintained by or implicates the spinal column or a system of muscular tension, particularly in the back, torso, neck or pelvis. In preferred embodiments the invention is directed to conditions affecting the lower back, such as chronic or acute back pain.

The invention provides a method and device by which incremental stretches of the relevant muscles can be achieved, preferably small or even minute incremental stretches. Continuous stretches are also possible. Preferably, the apparatus and its movement, including the exercise program, such as the speed, duration, and degree of incremental stretches and pauses, is entirely under the control of the person being treated. Alternatively, the apparatus can be controlled by someone else, such as a trained physical therapist or other professional, or the apparatus can be controlled by computer.

A device comprising a plurality of air-mattress-like inflatable cells is provided. The cells can be manufactured using existing and well-known technologies, and can include fingertip control, e.g. using pumps, to inflate and deflate cells. In a preferred embodiment the cells are arranged in such a fashion that the stretches relevant to the alleviation of lower back pain, and to the prevention of further back problems can be created by the person using the machine, e.g. by lying on the cells. These stretches can be produced individually and independently by anyone, without the unavoidable mistakes caused by the limitations of an outside observer. This is accomplished by providing the person being treated with control of the movements required to produce the precision stretches.

Preferably, each cell of the apparatus can be inflated and deflated independently, incrementally, and at various adjustable speeds. This provides a wide range of movement, and a wide variety of stretching and flexing routines for a person using the machine. In one embodiment, at least three cells are arranged in series to form a level, bed-like surface, when the cells are appropriately inflated. For a person lying face-up on the apparatus, one cell is placed generally underneath an supporting the user's head, another is generally beneath and supporting the user's back, and the third is generally beneath and supporting the users legs. If desired, two additional cells can be provided, one between the head-supporting cell and the back-supporting cell; the other between the back-supporting cell and the leg-supporting cell. The cells may be of different sizes. For example, the center cell may be larger than the end cells, which in turn may be larger than the in-between cells. Preferably, any arrangement of any number of cells can be arranged in a resting or starting position where all of the cells are reasonably firm are aligned to provide a generally planar surface, so that a person can lie flat across the cells.

Optionally, the cells can be covered, individually or in groups, by a relatively soft pad, such as a flexible foam support, or by a more rigid cover, such as slatted boards, a matrix of beads, any articulated support, or any other desired cover. Optionally any one or more cells, or any one or more cell covers may be heated or cooled, individually or in groups.

In one embodiment, the cells of the apparatus are placed on a frame. The frame may be fixed, for example to provide a support for the cells at a uniform height. Alternatively, and in a preferred embodiment, the frame is articulated to provide a range of movement for the supported cells. For example, the frame may be articulated to provide at least one pivot axis, allowing independent or coordinated up-and-down movement of cells or groups of cells. For example, one side or the other of the frame may be raised or lowered, thereby raising or lowering the cells carried on that portion of the frame. The motion of the frame, like the inflation and deflation of the cells, can be controlled, e.g. by the user, and preferably is incremental. Speed, duration, and degree of motion call all be controlled. This provides a range of movement in addition to the movement provided by the inflation and deflation of the cells. In an embodiment with three cells, the pivot axis of the frame is preferably placed at or near the center of the frame, e.g. underneath the center of the middle or back-supporting cell.

DETAILED DESCRIPTION OF THE INVENTION

A device of the invention comprises a plurality of inflatable cells. Preferably, each cell of the device can be independently inflated or deflated in small increments, for precise control of cell shape and firmness. Conventional materials can be used to make the cells, as are found for example in air mattresses and other inflatable devices. Cells can be inflated and deflated for example using pumps and/or valves. Preferably the device is provided with fingertip controls. For example, it is desirable for an individual to conveniently adjust (inflate/deflate) cells during use of the device.

Figure 1:
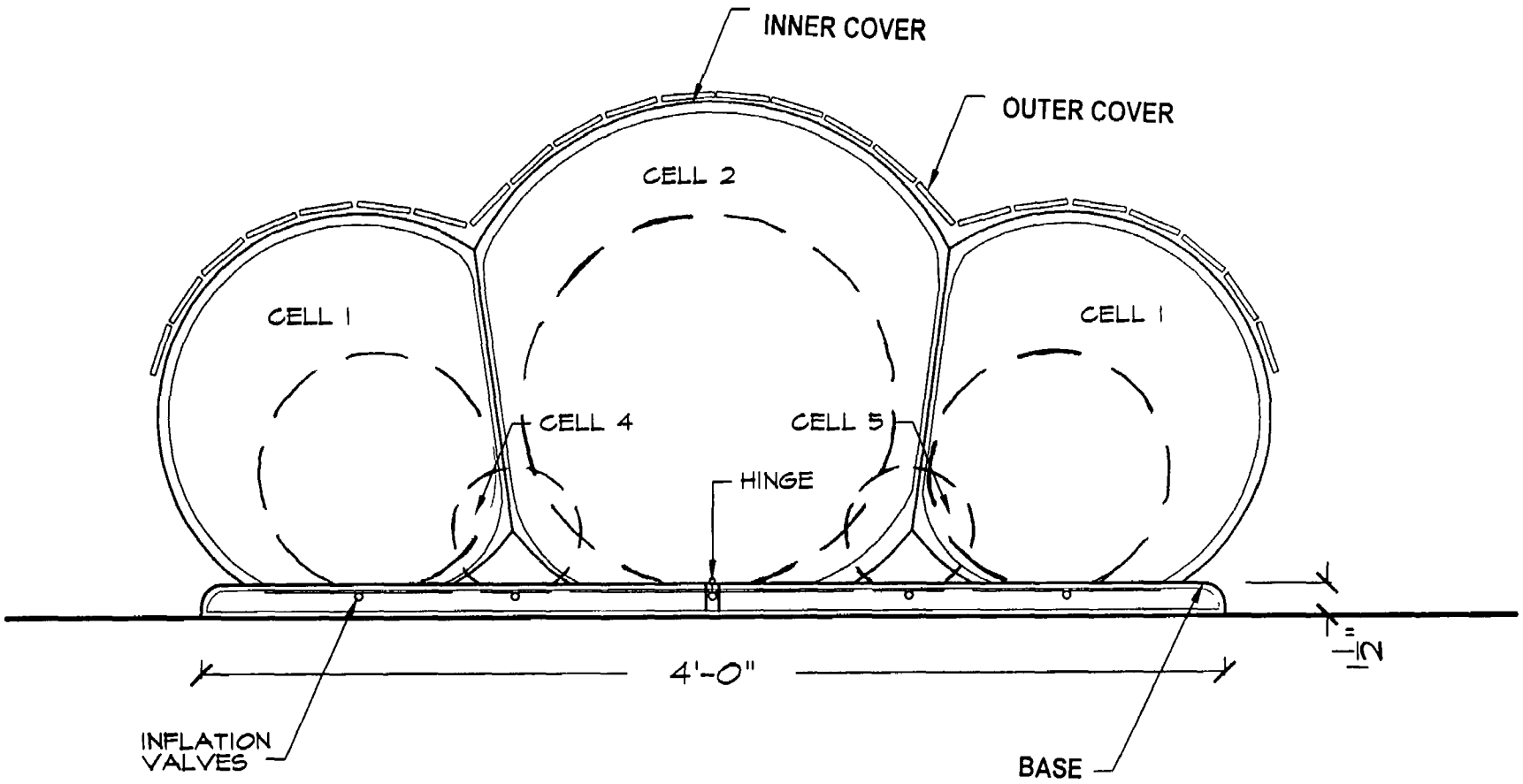
FIG. 1 is a side elevation and section plan of the device of FIG. 1.
Figure 2:
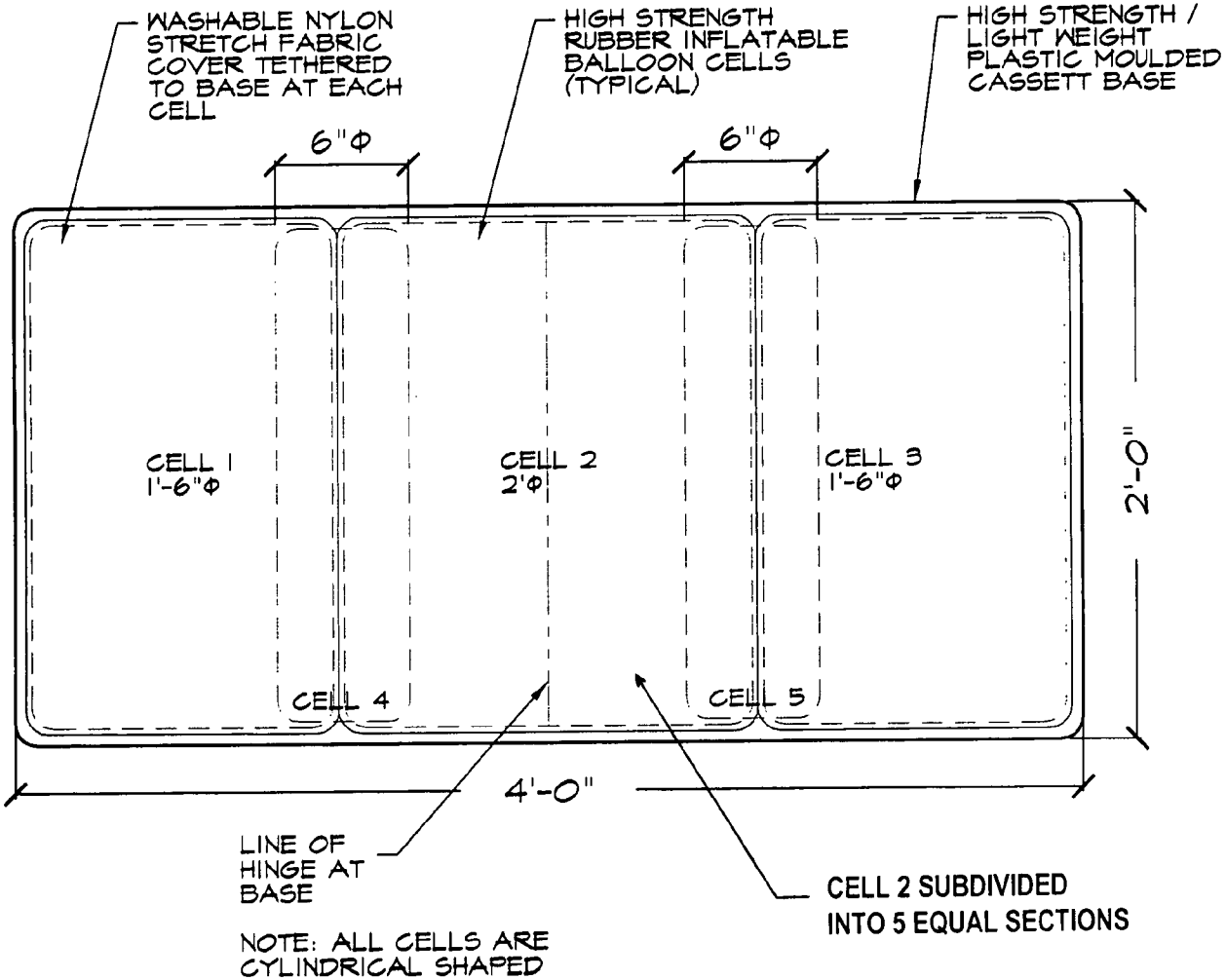
FIG. 2 is a plan view of a device according to the invention, showing the architecture of a representative five-cell device.

As shown in FIGS. 1 and 2, a preferred apparatus comprises at least three inflatable cells, preferably 5 inflatable cells, joined together to form an adjustable cushion on a supporting base. The base can be any suitable material, such as lightweight plastic, preferably recycled, wood or metal. A high-strength molded plastic is preferred. In the preferred embodiment the base is hinged into two sections. The cells can be formed using any elastic or flexible airtight material, such as natural or synthetic rubbers and the like. The cells are strong enough to support the weight of the human body when inflated; a high strength rubber or rubber-like material is preferred. The cells are preferably enclosed, all or in part, by a relatively soft inner cover, for example a fabric cover, preferably washable stretch nylon. The device also preferably has a flexible and relatively firm or supportive outer cover, comprised for example of slats (e.g. wooden slats) joined together by straps (e.g. nylon). The outer cover preferably is placed at least on the upper surface, opposite the base, of the cushion formed by the cells. Thus, the outer cover will be in contact with the individual using the device. Note also that the invention encompasses embodiments where one or both covers is omitted, where the order of the covers is reversed, or where additional layers or covers are added. For example, the outer cover can be protected by a further fabric layer, or a layer including heating elements can be used. A layer or layers can also be introduced to accommodate hot or cold gel packs, or to accommodate a liquid.

In the FIG. 1 embodiment, a large central cell (cell 2) is joined to and flanked by two medium cells (cells 1 and 3). The three cells are each supported by the base. The central cell (cell 2) is preferably subdivided into three equal sections perpendicular to the hinge line of the base. These sections can be independently inflated and deflated. FIG. 2. Preferably, a smaller cell is interposed and joined to the central cell and to each medium cell, at the base of the device (cells 4 and 5). The smaller cells can provide additional support and rigidity to the structure and conformation of the three main cells, as desired.

The cells can be of any suitable shape and size, however cylindrical or semi-cylindrical shapes are preferred. The cells should preferably be sized to support the human body. As shown, the base is about 3–4 feet long and 2 feet wide. FIG. 2. It supports all five cells along its length. The cushions have substantially the same width as the base. The central cushion has a length of about two feet, and each medium cushion has a length of about 1.5 feet. The two smaller cushions each have a length about 6 inches. These dimensions are not critical, but these or similar dimensions are preferred. Likewise, it is preferred that the cell lengths have a ratio of (small:medium:large) of about (1:3:4). In certain embodiments having cylindrical or semi-cylindrical cells the length can also be the diameter of the cell, e.g. when the cell is fully inflated. Dimensional relationships similar to the lengths described here also apply to the height of each cell.

The base of the device preferably houses pump and valve mechanisms (not shown) to supply each cell with air. Preferably, an electronic control is also provided (not shown) to allow the cells to be inflated or deflated, separately or in groups, while the device is in use. The inflation or deflation of each cell can be accomplished in increments, preferably relatively fine increments, to precisely control the shape and rigidity of the cells and the complete cushion. Preferably these increments are reproducible, so that the same degree of inflation and deflation, with the same precision and results, can be obtained repeatedly for each individual, for example from one use to another, to accommodate a user's changing needs or exercise program, or to accommodate different users.

In use, an individual lies down with his or her back supported by the outer (slatted) cover of a fully or largely deflated (flat) cushion structure. The cushion comprises a series of interconnected, independently inflatable, cylindrical cells as described. By inflating and/or deflating specific cells, the user achieves stretches of the major and minor muscle groups that are necessary to achieve lower back muscle relaxation. Precision stretches and a closely tailored individual program can be obtained. With appropriate experimentation and/or instruction, the exercise activity can be optimized and can proceed to the desired degree and at the desired pace under tightly self-controlled conditions. Users produce precise stretches by controlling the rate and degree of inflation or deflation of each cell or group of cells. Stretching can occur passively, as when the body conforms to the shape of the cushion, or actively by exercising in concert with the conformation of the cushion. Anxiety and fear will be gradually reduced by the experience of control and the safety, e.g. incremental inflation/deflation, accompanying that control. The reduction in fear will support the slowly graduated, incremental increases of the degree of stretching leading to complete alleviation of the pain. Routine use of the apparatus will help the individual to maintain a level of relaxation and flexibility that will make reoccurrence of lower back pain unlikely.

FIG. 1 shows the cells of this exemplary apparatus inflated to provide an arch or curvature to a person lying down on the cells, on his or her back. That is, a person lying on his or her back, with the head on cell 1, and the legs on cell 3, will have an arched back produced by the raised portion of cell 2 as shown. The degree of curvature can be increased, preferably incrementally, by further inflating cell 2, deflating cell 1, deflating cell 3, or any combination thereof. Inflating and deflating cells 4 and 5, as shown, may provide a further range of movement. Note also that additional cells could be placed above and between cells 1 and 2 and cells 2 and 3, respectively (not shown). In a maximum downward arch or inverted-V position (Λ), cells 1 and 3 of FIG. 1 (and optionally cells 4 and 5) are completely deflated and cell 2 is completely inflated. The reverse position, an upward arch or "V" position, can be achieved by reversing the relative inflation and deflation of the cells. In a maximum upward arch, cells 1 and 2 (optionally also cells 4 and 5) are completely inflated and cell 2 is completely deflated.

Inflation and deflation can be done in stages, at any desired pace and in any order. Cells can be inflated and deflated independently or in concert. For example, cell 1 can be deflated independently of cell 3 to lower e.g. the head without lowering the legs. Cell 1 can be inflated, and cells 2 and 3 deflated, to bring the user into an upright "L" or sitting position. In preferred embodiments, the cells are positioned and inflated to provide a rest or starting position, whereby a person can lie flat on his or her back across the cells, e.g. with the head placed on cell 1 and the legs across cell 3. Any combination, order, or pattern of inflation and deflation is within the scope of the invention, to provide any stretches or exercises within the full range of motion of the machine. Note also that although a prone position is preferred, particularly face up, a person may be positioned on the machine in any desirable way, e.g. face up, face down, or one's side.

Methods and devices for inflating and deflating the cells are known, including incremental and variable speed methods and devices. Any such method may be used, including for example pump and valve arrangements, computer-controlled pneumatic systems, etc.

In another embodiment, the device of FIG. 1, or a group of cells, is placed on an articulated frame (not shown). For example, the base shown in FIG. 1 can be (or be placed on) a frame, e.g. a tubular metal frame having an armature which supports the cells, e.g. a desired height above the floor. The frame is provided with a pivot axis which replaces or is placed under the hinge of the base in FIG. 1. In a preferred embodiment the base is unnecessary. The cells rest on and are affixed directly to the frame, with the center cell (cell 2 in FIG. 1) placed centrally over the pivot axis. In this way, the armature of the frame on either side of the pivot axis can be raised or lowered. This provides a wider range of motion for the device, for example by increasing the maximum upward and downward arch positions.

In one embodiment, the pivot axis is lowered or raised by jack screws affixed to a motor, e.g. which can be stepped or not, to incrementally or continuously raise and lower the central pivot axis. In this embodiment, raising the jack screw causes the ends of the frame to pivot downward forming an inverted-V (Λ) shape. Lowering the jack screw causes the ends of the frame to pivot upward forming a V shape. This movement carries the cells, particularly the end cells (e.g. cells 1 and 3 in FIG. 1), which tend to conform to the shape of the frame. The user, positioned on the cells, will also tend to stretch and flex to conform to the shape of the frame. In this embodiment the ends of the frame move together in response to the up/down movement and position of the jack screw. Alternatively, the frame sections can be independently motorized, using conventional means, to move about the pivot point separately or together as desired. Additional pivot points can also be used, as desired, to provide a wider variety of motion.

While the invention has been particularly shown and described with reference to preferred embodiments thereof, it will be understood by those skilled in the art that various changes in form and details may be made without departing from the spirit and scope of the invention.

I claim:

1. A stretching and exercise apparatus comprising at least three independently inflatable and deflatable cells that abut each other, and share a planar support having at least one rotational axis, whereby the cells and planar support cooperate to form an incrementally adjustable surface having a plurality of contoured shapes corresponding to a plurality of exercise positions having selected angles or degrees of stretch.

2. The apparatus of claim 1, wherein the cells are attached to each other and to the planar support.

3. The apparatus of claim 2, wherein the planar support is articulated within a region supporting at least one cell and corresponding to at least one rotational axis.

4. The apparatus of claim 1, wherein one of the three cells is a large cell centrally positioned between two medium cells.

5. The apparatus of claim 4, wherein the two medium cells are about the same size.

6. The apparatus of claim 5, wherein the cells have about the same width, and the length and height of each medium cell is about 75% of the length and height of the large cell.

7. The apparatus of claim 1 comprising at least 5 cells.

8. The apparatus of claim 4, further comprising at least one small cell that shares the planar support and abuts both the large central cell and at least one medium cell.

9. The apparatus of claim 8, wherein a small cell is affixed between the large central cell and each medium cell.

10. The apparatus of claim 9, wherein the planar support is articulated, and the cells are attached to the planar support.

11. The apparatus of claim 10, wherein one or both of the length and height of a medium cell is about three times the length or height of a small cell, and one or both of the length and height of a large cell is about four times the length or height of a small cell.

12. The apparatus of claim 4, further comprising at least one of an inner cover and an outer cover.

13. The apparatus of claim 12, wherein the inner cover is a stretch fabric.

14. The apparatus of claim 12, wherein the outer cover comprises one of a flexible pad and a series of articulated slats, covering at least a portion of the cells on a surface opposite the common support.

15. The apparatus of claim 9, further comprising an outer cover comprising a series of articulated slats covering at least a portion of the large and medium cells on a surface opposite the common support.

16. The apparatus of claim 1, wherein each cell is inflated and deflated incrementally, to provide a selected contoured shape having a controlled degree of curvature.

17. The apparatus of claim 4, wherein each cell is substantially cylindrical in shape.

18. The apparatus of claim 10, wherein each cell is substantially cylindrical in shape.

19. The apparatus of claim 4, additionally comprising a heated layer positioned on at least a surface of the cells opposite to the shared support.

20. The apparatus of claim 10, additionally comprising a heated layer positioned on at least a surface of the cells opposite to the shared support.

21. A method for performing stretching exercises comprising the steps of lying down on a cushion comprising at least three independently inflatable and deflatable cells that abut each other and which share an adjustable planar support, selecting the position of the planar support, and inflating or deflating at least one cell to provide at least one stretch exercise having a selected angle or degree of stretch corresponding to the position of the planar support and a change in the conformation of the cushion.

22. The method of claim 21, wherein the cells are attached to each other and to the planar support, the position of the planar support is adjusted incrementally, one of the three cells is a large cell centrally positioned between two medium cells, and each cell is inflated and deflated in controlled increments.

23. The method of claim 22, wherein the two medium cells are about the same size, the cells have about the same width, and the length and height of each medium cell is about 75% of the length and height of the large cell.

24. A method for performing stretching exercises comprising the steps of lying down on a cushion comprising at least three incrementally and independently inflatable and deflatable cells that abut each other and which are affixed to an incrementally moveable frame, and changing the conformation of the cushion to provide a selected angle or degree of stretch by at least one of inflating at least one cell, deflating at least one cell, and moving at least a portion of the frame.

25. The method of claim 24, wherein one of the three cells is a large cell centrally positioned between two medium cells.

26. The method of claim 25, wherein one or both of the length and height of a medium cell is about three times the length or height of a small cell.

27. The method of claim 22 wherein each cell is substantially cylindrical.

28. The method of claim 25 wherein each cell is substantially cylindrical.

29. The method of claim 22, wherein at least one cell surface is heated.

30. An apparatus of claim 1, wherein at least one cell is divided into at least two chambers, and each chamber is independently inflatable and deflatable.

31. An apparatus of claim 4, wherein at least the large central cell is divided into at least two chambers, and each chamber is independently inflatable and deflatable.

32. An apparatus of claim 31, wherein the central cell is divided into three equal chambers.

33. An apparatus of claim 10, wherein at least the large central cell is divided into at least two chambers, and each chamber is independently inflatable and deflatable.

34. An apparatus of claim 10, wherein the central cell is divided into three equal chambers, each of which is independently inflatable and deflatable.

35. The apparatus of claim 1, wherein at least one of the cells and planar support are affixed to an articulated frame having at least a first and second armature joined at a first pivot axis corresponding to the at least one rotational axis.

36. The apparatus of claim 35, wherein one of the three cells is a large cell centrally positioned between two medium cells, and the first pivot axis is centrally located under the large cell.

37. The apparatus or claim 36, wherein at least one armature rotates through an angle about at least one pivot point, whereby the angular positions of at least one cell and at least one portion of the planar support is incrementally changed.

38. The apparatus of claim 37, wherein each cell is inflated and deflated incrementally to provide contoured shapes corresponding to a range of arched positions.

39. The apparatus of claim 38, wherein at least a portion of the cells are covered by one of a flexible pad and a series of articulated slats.

40. The apparatus of claim 1, wherein the contoured shapes provide degrees of curvature corresponding to a range of exercise positions extending from a rest position to an upward or downward arch position.

41. The apparatus of claim 1, wherein the cells are capable of being inflated or deflated at various adjustable speeds.

42. The method of claim 21, wherein the conformation of the cushion provides degrees of curvature corresponding to a range of exercise positions extending from a rest position to an upward or downward arch position.

43. The method of claim 21, wherein the cells are capable of being inflated or deflated at various adjustable speeds.

44. The method of claim 24, wherein the conformation of the cushion provides degrees of curvature corresponding to a range of exercise positions extending from a rest position to an upward or downward arch position.

45. The method of claim 24, wherein the cells are capable of being inflated or deflated at various adjustable speeds.

* * * * *